US007864114B2

(12) United States Patent
Sanada

(10) Patent No.: US 7,864,114 B2
(45) Date of Patent: Jan. 4, 2011

(54) NEGATIVE PERMEABILITY OR NEGATIVE PERMITTIVITY META MATERIAL AND SURFACE WAVE WAVEGUIDE

(75) Inventor: Atsushi Sanada, Ube (JP)

(73) Assignee: National University Corporation Yamaguchi University, Yamaguchi (JP)

( * ) Notice: Subject to any disclaimer, the term of this patent is extended or adjusted under 35 U.S.C. 154(b) by 670 days.

(21) Appl. No.: 11/817,552

(22) PCT Filed: Feb. 27, 2006

(86) PCT No.: PCT/JP2006/304186

§ 371 (c)(1),
(2), (4) Date: Aug. 31, 2007

(87) PCT Pub. No.: WO2006/093302

PCT Pub. Date: Sep. 8, 2006

(65) Prior Publication Data

US 2009/0033586 A1 Feb. 5, 2009

(30) Foreign Application Priority Data

Mar. 2, 2005 (JP) ..... 2005-057763

(51) Int. Cl.
*H01Q 1/38* (2006.01)

(52) U.S. Cl. ..... 343/700 MS; 343/911 R

(58) Field of Classification Search ..... 343/909, 343/756, 700 MS, 911 R
See application file for complete search history.

(56) References Cited

U.S. PATENT DOCUMENTS

| | | | | |
|---|---|---|---|---|
| 5,728,346 | A | 3/1998 | Haq | |
| 6,963,259 | B2 * | 11/2005 | Killen et al. | 333/219 |
| 2004/0140945 | A1 * | 7/2004 | Werner et al. | 343/909 |
| 2005/0225492 | A1 * | 10/2005 | Metz | 343/753 |

(Continued)

FOREIGN PATENT DOCUMENTS

JP 2002-534883 10/2002

(Continued)

OTHER PUBLICATIONS

H. Raether, "Surface Plasmons on Smooth and Rough Surfaces and on Gratings", Springer-Verlag, 1988 (8 pages).

(Continued)

*Primary Examiner*—Huedung Mancuso
(74) *Attorney, Agent, or Firm*—Antonelli, Terry, Stout & Kraus, LLP.

(57) ABSTRACT

Each of unit cells constituting a negative permeability medium includes a metal patch formed on a surface of a dielectric substrate. The dielectric substrate has a rear surface having a ground conductor formed on its entire surface. A positive permeability medium is an existing micro strip line and each of unit cells has a two-dimensional structure having a metal strip connected in four directions. The dielectric substrate has a rear surface having a ground conductor formed on its entire surface. The negative permeability medium is arranged at the left side adjacent to the positive permeability medium formed by unit cells arranged at the right side so that the media oppose to each other. A waveguide formed by the positive/negative permittivity medium or the positive/negative permeability medium of the meta material for propagation of a surface wave is formed at the boundary of the two media.

14 Claims, 12 Drawing Sheets

U.S. PATENT DOCUMENTS

2006/0152430 A1 * 7/2006 Seddon et al. ..... 343/909

FOREIGN PATENT DOCUMENTS

JP 2003-526423 9/2003
WO WO 00/41270 7/2000
WO WO 01/67549 A2 9/2001
WO WO 2004/025783 A1 3/2004

OTHER PUBLICATIONS

B. Lax and K J Button, "Microwave Ferrite and Ferrimagnetics", McGraw-Hill, 1962, pp. 297-307.

* cited by examiner

| | | | | |
|---|---|---|---|---|
| μ-NEGATIVE MEDIUM | $Z_n$ | L C | $Y_n$ | C |
| μ-POSITIVE MEDIUM | $Z_p$ | L | $Y_p$ | C |

NEGATIVE PERMEABILITY OR NEGATIVE PERMITTIVITY META MATERIAL AND SURFACE WAVE WAVEGUIDE

TECHNICAL FIELD

The present invention relates to positive/negative permittivity medium or positive/negative permeability medium formed by meta material and surface wave propagating waveguide using the same.

BACKGROUND ART

Media having properties not found in nature can be artificially composed by arranging small pieces of metal, dielectric, magnetic substance, superconducting substance and the like at sufficiently short intervals relative to the wavelength (about 1/10 of the wavelength or less). Such media are known as metamaterials in the sense that they surpass media available from nature. Whereas the properties of metamaterials vary in many different ways according to the shape and material of unit particles and their arrangement, metamaterials whose equivalent permittivity $\epsilon$ and permeability $\mu$ become negative at the same time in particular are named "left-handed materials" as their electric field, magnetic field and wave vector constitute a left-handed system. As opposed to them, conventional materials whose equivalent permittivity $\epsilon$ and permeability $\mu$ become positive at the same time are called "right-handed materials". The regions of relationship among these permittivity $\epsilon$, permeability $\mu$ and media can be classified into media of the first through fourth quadrants according to the positiveness/negativeness of permittivity $\epsilon$ and that of permeability $\mu$ as shown in FIG. 1.

In particular, "left-handed materials" have peculiar features including the presence of waves whose signs of group velocity (the velocity at which energy propagates) and phase velocity (the velocity at which phase proceeds) are inverted, known as backward waves, and the amplification of the evanescent wave, which is a wave exponentially attenuating in the non-propagating region.

The surface waves are known to propagate on the boundary between media which are not metamaterials (naturally continuous media) but the sign of whose permittivity $\epsilon$ is negative (negative permittivity media) and those the sign of whose permittivity $\epsilon$ is positive (positive permittivity media). For instance, as revealed in H. Raether, "Surface plasmons on smooth and rough surfaces and on gratings," Springer-Verlag, 1988" (Reference 1), the permittivity of metal in the optical region is negative, and surface waves known as surface plasmons are present on the boundary between air and dielectrics, whose permittivity is positive.

By contrast, surface waves are also present on the boundary between media the sign of whose permeability $\mu$ is negative (negative permeability media) and those the sign of whose permeability $\mu$ is positive (positive permeability media). As disclosed in B. Lax and K J Button, "Microwave Ferrite and Ferrimagnetics," McGraw-Hill, 1962 (Reference 2), it is known that the equivalent permeability of magnetized ferrite becomes negative in the high frequency region, and surface waves propagate on the boundary between them and air or dielectrics, whose permeability is positive.

Thus, surface waves propagate on the boundary between media the sign of whose permittivity $\epsilon$ or permeability $\mu$ is negative and those the sign of whose permittivity $\epsilon$ and permeability $\mu$ are both positive. In particular, a state in which surface waves propagate on the boundary between media the sign of whose permeability $\mu$ is negative and media the sign of whose permeability $\mu$ is positive is shown in FIG. 2.

However, the negative permittivity characteristic of metal in the optical region and the negative permeability characteristic of magnetized ferrite are the intrinsic properties of materials available from nature, and neither their permittivity $\epsilon$ nor permeability $\mu$ can be designed as desired. Therefore, the surface wave propagation frequency band, which is determined by these characteristics, can neither be determined nor designed as desired. For instance, whereas surface plasmons attributable to the negative permittivity characteristic of metal constitute a phenomenon in the optical region, and the transmission band of the surface magnetostatic wave of ferrite is determined by the direction and magnitude of the applied D.C. magnetic field, even if the D.C. magnetic field of a realistic number T (Tesla) is added, the microwave region will be the upper limit. Nor is there any easy way to excite these surface plasmons or surface magnetostatic wave.

DISCLOSURE OF THE INVENTION

Therefore, an object of the present invention is to configure, by using the concept of metamaterial according to which a medium effectively having required properties by arranging metal, dielectric, magnetic substance, superconducting substance, semiconductor and the like at short intervals relative to the wavelength to be used, a negative permittivity medium or a negative permeability medium and a waveguide for transmitting the surface waves thereof.

In order to achieve the object stated above, a negative permeability metamaterial according to an aspect of the invention includes a dielectric substrate; a grounding conductor formed over the entire rear surface of the dielectric substrate; and a plurality of conductor patterns periodically arrayed over the front surface of the dielectric substrate and formed in a square shape, wherein the conductor patterns are disposed under D.C. insulation from other conductor patterns and the grounding conductor; the metamaterial manifesting negative permeability to propagating electromagnetic waves.

Since it is a negative permeability medium formed of a metamaterial, the value of the permeability $\mu$ can be designed as desired and, when applied to a waveguide, the surface wave propagation frequency band determined by that value can be determined or designed as desired.

In a negative permeability metamaterial according to an aspect of the invention, the vertical and lateral lengths of the conductor patterns are differentiated to enable the negative permeability metamaterial to have anisotropy regarding permeability.

This makes anisotropy controllable by appropriately designing the unit cells. Control of anisotropy enables the permeability to be differentiated with the difference in direction, and devices using this medium would permit designing with greater freedom.

A negative permeability metamaterial according to another aspect of the invention includes a dielectric substrate; a grounding conductor formed over the entire rear surface of the dielectric substrate; and a plurality of conductor patterns periodically arrayed over the front surface of the dielectric substrate and formed in a hexagonal shape, wherein the conductor patterns are disposed under D.C. insulation from other conductor patterns and the grounding conductor; the metamaterial manifesting negative permeability to propagating electromagnetic waves.

This enables a negative permeability medium formed of a metamaterial low in anisotropy to be obtained and the value of the permeability $\mu$ to be designed as desired and, when applied to a waveguide, the surface wave propagation frequency band determined by that value can be determined or designed as desired.

A negative permittivity metamaterial according to a further aspect of the invention includes a dielectric substrate; a grounding conductor formed over the entire rear surface of the dielectric substrate; a first conductor strip formed in a first direction over the front surface of the dielectric substrate and arrayed periodically; a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, the metamaterial manifesting negative permittivity to propagating electromagnetic waves.

Since this is a negative permittivity medium formed of a metamaterial, the value of the permittivity $\epsilon$ can be designed as desired and, when applied to a waveguide, the surface wave propagation frequency band determined by that value can be determined or designed as desired.

A negative permittivity metamaterial according to a still further aspect of the invention includes a dielectric substrate; a grounding conductor formed over the entire rear surface of the dielectric substrate; a first conductor strip formed in a first direction over the front surface of the dielectric substrate and arrayed periodically; a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, the metamaterial manifesting negative permittivity to propagating electromagnetic waves.

Since this enables a negative permittivity medium formed of a metamaterial smaller in anisotropy than a square one and the value of the permittivity $\epsilon$ can be designed as desired and, when applied to a waveguide, the surface wave propagation frequency band determined by that value can be determined or designed as desired.

In a negative permittivity metamaterial according to another aspect of the invention, anisotropy regarding permeability can be provided by decomposing the directional symmetry of the conductor strips. Further in a negative permittivity metamaterial according to still another aspect of the invention, anisotropy regarding permeability can be provided by altering the position of the conductor via.

This makes possible control of anisotropy by appropriately designing the unit cells. The control of anisotropy makes possible differentiation of the permittivity with the difference in direction, and devices using this medium would permit designing with greater freedom.

A medium having a positive permittivity and a positive permeability in a surface wave waveguide according to the invention constitutes unit cells in a two-dimensional structure in which metal strips are connected in four directions over the front surface of a dielectric substrate and a grounding conductor is arranged over the entire rear surface of the dielectric substrate, and a plurality of the unit cells are put together.

Since it is a positive permeability medium or a positive permittivity medium formed of a metamaterial, the values of the permeability $\mu$ and the permittivity $\epsilon$ can be designed as desired and, when applied to a waveguide, the surface wave propagation frequency band determined by those values can be determined or designed as desired.

In a surface wave waveguide according to the invention, the negative permeability metamaterial and a positive permeability medium having a positive permeability are positioned adjacent to each other, and surface waves are enabled to propagate on the boundary between the negative permeability metamaterial and the positive permeability medium.

In a surface wave waveguide according to another aspect of the invention, the negative permittivity metamaterial and a positive permittivity medium having a positive permittivity are positioned adjacent to each other, and surface waves are enabled to propagate on the boundary between the negative permittivity metamaterial and the positive permittivity medium.

Whereas the wavelength in the waveguide is determined by the equivalent permittivity and permeability of these media, appropriate designing of these values can make the wavelength in the waveguide smaller than that in vacuum. It is possible to fabricate small resonators or small delay lines by utilizing this wavelength shortening effect. Also, anisotropic control is made possible by appropriately designing unit cells. The anisotropic control makes possible device designing with a greater margin of freedom by using these media.

ADVANTAGES OF THE INVENTION

As stated above, the invention makes it possible to provide a waveguide for transferring surface waves, operable at a wide variety of frequencies from a low frequency theoretically close to a D.C. to THz or above. Whereas the wavelength in this waveguide is determined by the equivalent permittivity and permeability of these media, the wavelength in the waveguide can be made shorter than that in vacuum by appropriately designing these values. It is possible to fabricate small resonators or small delay lines by utilizing this wavelength shortening effect. Also, anisotropic control is made possible by appropriately designing unit cells. The anisotropic control makes possible device designing with a greater margin of freedom by using these media.

On the other hand, for the excitation of surface plasmons in the optical region, an excitation wave of a high frequency should be created by using a dielectric prism and grating. Whereas the excitation of a surface magnetostatic wave also requires a device for conversion of electromagnetic wave in the microwave band to a magnetostatic wave, such as a transducer, the surface wave mode of media according to the invention excels in affinity with planar circuits, and excitation is easily possible from a usual planar circuit, such as a micro strip line.

BEST MODES FOR CARRYING OUT THE INVENTION

Figure 1:
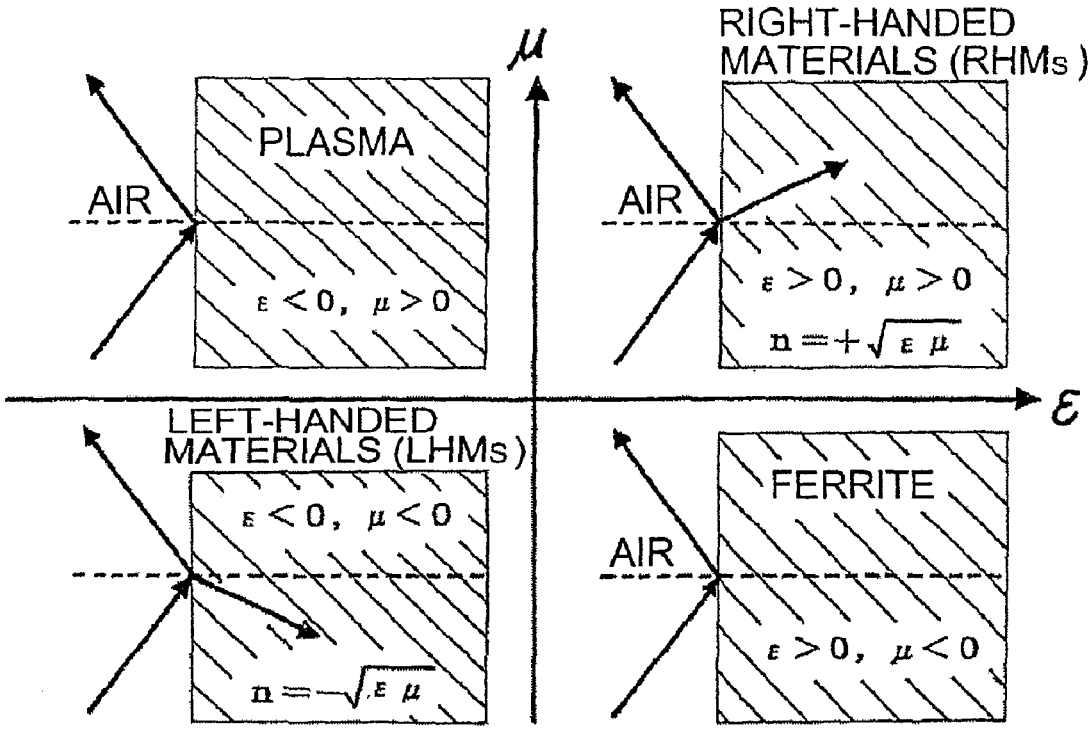
FIG. 1 shows the regions of relationship among permittivity $\epsilon$, permeability $\mu$ and media.
Figure 2:
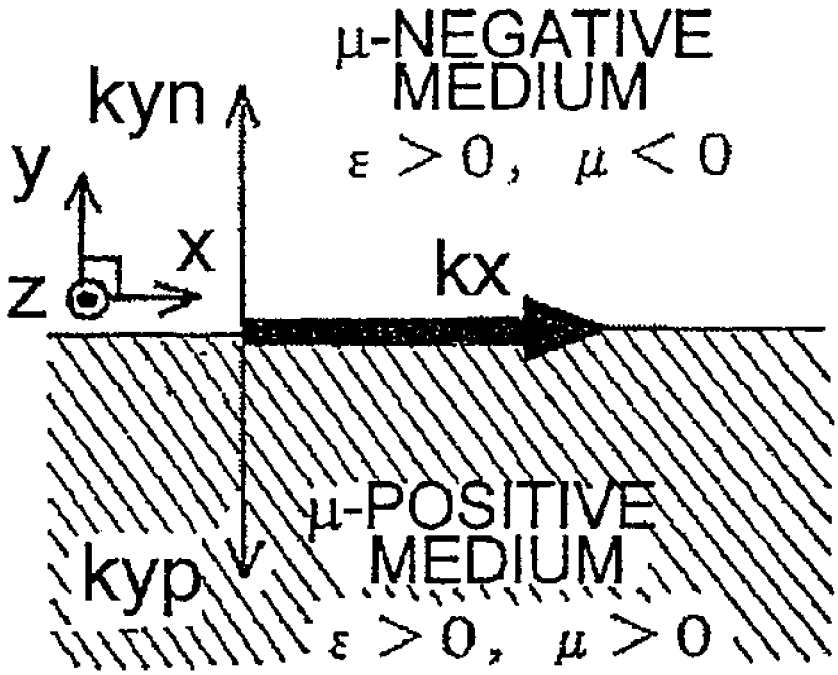
FIG. 2 shows a usual state of surface wave propagation.
Figure 3:
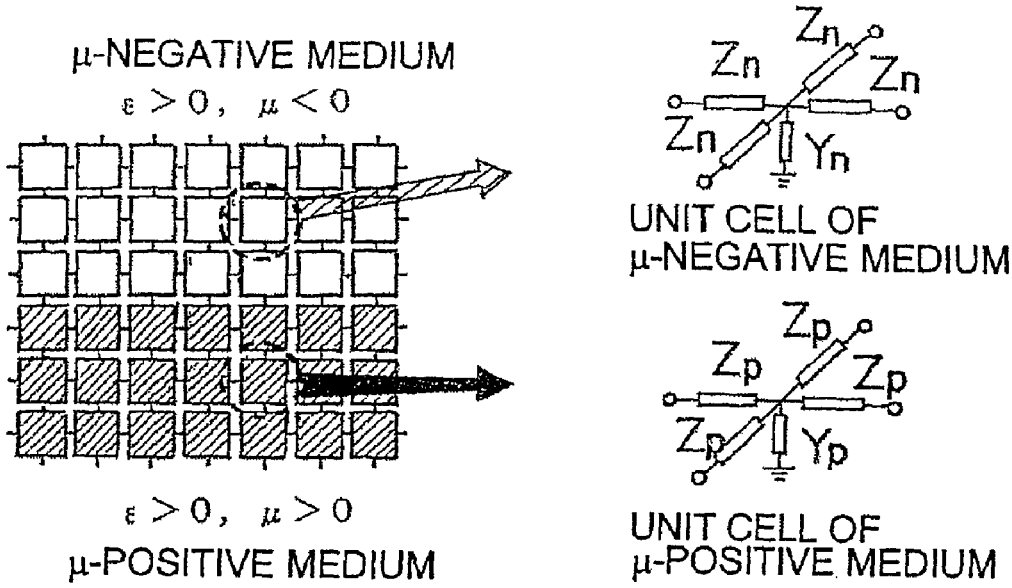
FIG. 3 shows a model of two-dimensional surface wave transmission line.

The basic configuration of the present invention, as represented by the model of two-dimensional surface wave transmission line shown in FIG. 3, concerns a negative permeability medium, wherein surface waves propagate on the boundary of a combination of a negative permeability medium (μ-negative medium) and a positive permeability medium (μ-positive medium). An equivalent circuit to the unit cell of each medium is shown toward the right, and the circuit elements of this equivalent circuit are configured as tabulated there. The modes for carrying out the invention will be described below with respect to a negative permeability medium and a negative permittivity medium.

Embodiment 1

Figure 4:
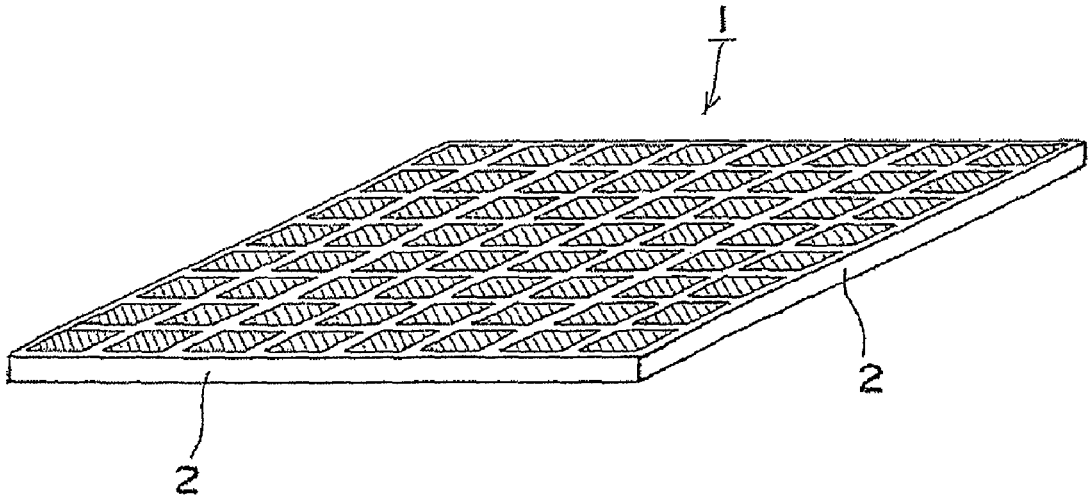
FIG. 4 schematically shows a negative permeability medium of a periodic structure according to the invention.

FIG. 4, showing a first embodiment of the invention with respect to a permeability medium (metamaterial), is a schematic diagram of a periodically structured permeability medium 1 formed of a medium having a negative permeability (μ-negative medium).

Figure 5A:
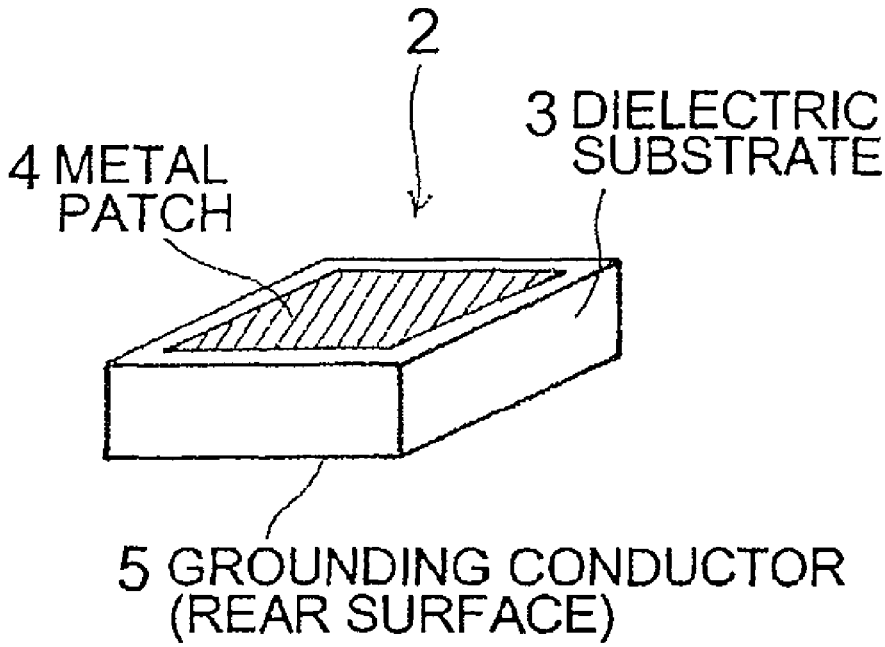
FIGS. 5(A) and 5(B) show a unit cell constituting the negative permeability medium according to the invention and an equivalent circuit, respectively.

FIG. 5(A) shows a unit cell 2 constituting the negative permeability medium 1 of FIG. 4. This unit, formed around a metal patch (i.e., metal pattern) 4 on the front surface of a dielectric substrate 3, is so structured as to leave the dielectric and to have a grounding conductor 5 all over the rear surface of the substrate 3. The metal patch here is a metal pattern (conductor pattern) in a thin-flake shape as illustrated.

Figure 5B:
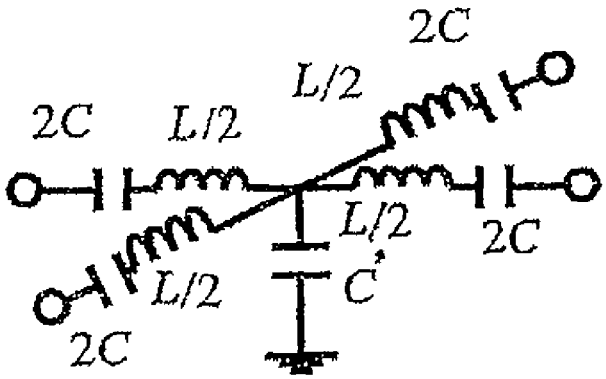

FIG. 5(B) shows equivalent circuit to this unit cell 2. This unit cell 2 has capacitances C in series to the adjacent metal patches (i.e., metal patterns) 4 and at the same time a capacitance C' in parallel to a grounding face on the rear surface of the substrate 3. To be strict, a parasitic inductance L has to be considered in respect of series, but usually this is small enough to be ignored. A medium having such a serial capacitance C and a parallel capacitance C' in the range where the serial inductance L is negligible is proven to be a medium equivalently having a negative permeability.

Figure 6:
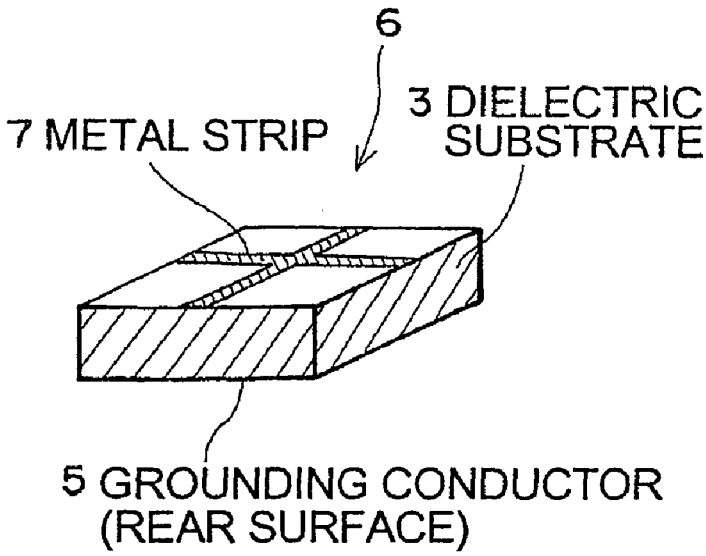
FIG. 6 shows a unit cell of the medium having a positive permittivity and permeability.

FIG. 6, on the other hand, shows the configuration of a unit cell 6 of the medium having both positive permittivity and positive permeability (μ-positive medium and ϵ-positive medium). This is a known micro strip line, having a two-dimensional structure in which a metal strip 7 is connected in four directions on the surface of the dielectric substrate 3. As in the configuration shown in FIG. 5, the grounding conductor 5 is disposed over the entire rear surface of the substrate 3. By configuring a plurality of such unit cells 6 as a collective body, the medium having both positive permittivity and positive permeability can be obtained, though not shown.

Figure 7:
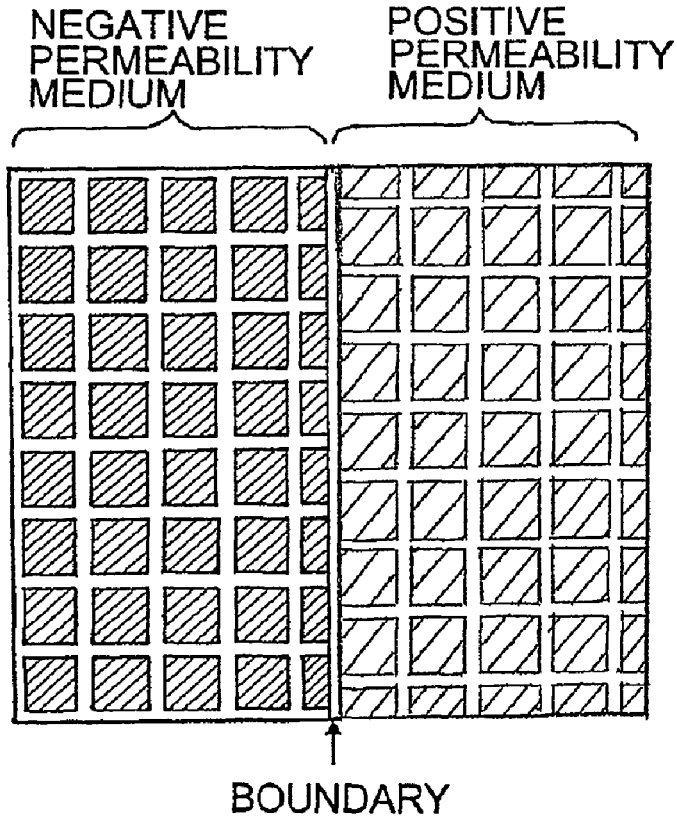
FIG. 7 is a conceptual diagram of a boundary between a negative permeability medium and a positive permeability medium according to the invention.

FIG. 7 is a conceptual diagram of a boundary between the negative permeability medium of FIG. 4 and the positive permeability medium of FIG. 6 combined side by side with each other. Assuming that, for the sake of simplicity, the periods of the negative permeability medium and of the positive permeability medium are equal, this boundary itself is a periodic structure, too.

Figure 8:
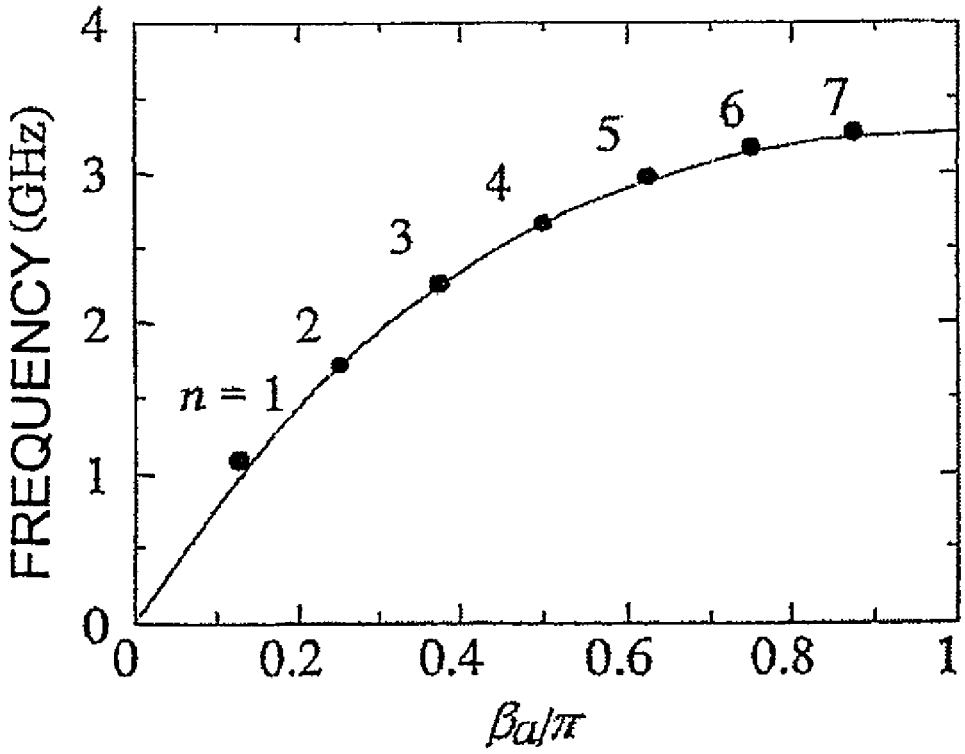
FIG. 8 shows the relationship of dispersion in the surface wave mode of media according to the invention.

FIG. 8 shows the result of calculation of the relationship of dispersion of surface waves propagating over this boundary, figured out of the boundary for one period in the periodic structure of FIG. 7 by performing three-dimensional electromagnetic field simulation based on a finite element method. The horizontal axis represents values obtained by standardization of the number β of these surface waves by π/a (a is the length of one side of the unit cell and π, the circular constant), while the vertical axis represents the frequency of the propagating surface waves. It is seen that, in this structure, there is a propagating wave having a dispersion characteristic such that βa/π approaches 1 as the frequency nears 3.2 GHz.

Figure 9:
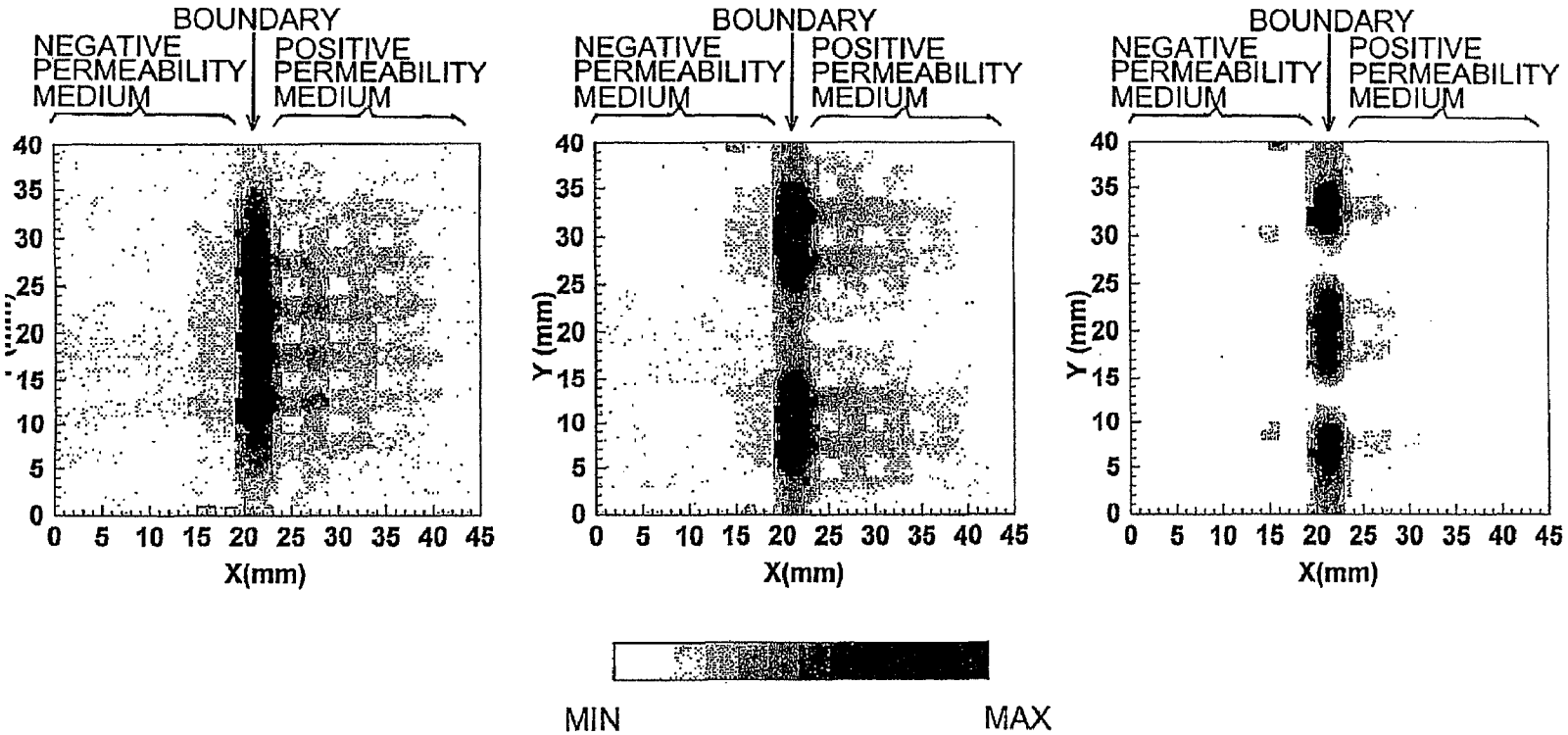
FIG. 9 shows the distribution of field intensity on the substrate surface of a two end short-circuited surface wave mode resonator.

FIG. 9 shows the results of three-dimensional electromagnetic field simulation by a finite element method of the electric field distribution on the substrate surface of a two end short-circuited surface wave mode resonator configured by short-circuiting with metal walls at the two ends, figured out of the boundary for an eight-period equivalent of in the periodic structure of FIG. 7. In these diagrams, with respect to mode numbers, the electric field distribution in each of the resonation modes of n=1, 2 and 3 is shown. It is seen that in every case there is a surface wave in which the electric field concentrates on the boundary. Further, plotting on each of the graphs of FIG. 8 the relationship between the number of waves and the frequency in each of the resonation modes of n=1 to 7 obtained in this way gives the dots in the graphs. Since the dot matching each resonation coincides with the relationship of dispersion of surface wave modes, it can be confirmed that these are resonation in surface wave modes.

The surface patches need not be square, but may be in any shape if only a capacitance in series can accompany them. The more the symmetry of the patch shape collapses, the stronger the anisotropy. For instance for rectangular patches, the greater the ratio between the vertical and lateral sides, the greater the difference between the permeability of waves in the vertical direction and that in the lateral direction. Nor do the unit cells themselves need to be square. The more the symmetry of the unit cell shape collapses, the stronger the anisotropy. Anisotropy can be controlled in this way as well.

Embodiment 2

Figure 10A:
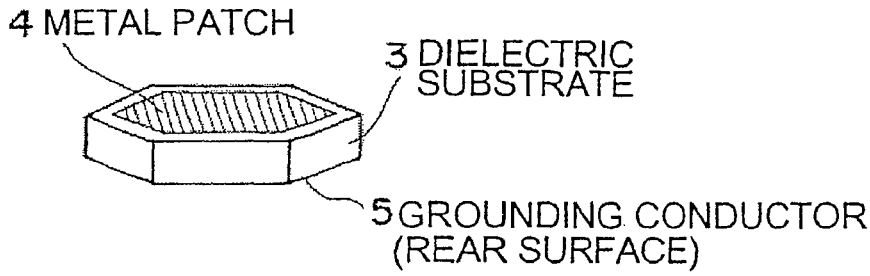
FIGS. 10(A) and 10(B) show a hexagonal negative permeability medium unit cell and the medium configuration thereof, respectively.
Figure 10B:
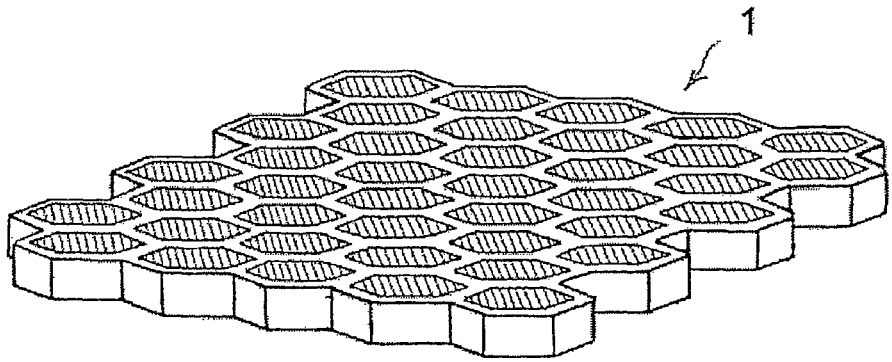

Next, another embodiment will be described. FIG. 10 schematically show a negative permeability medium, which is a second embodiment of the invention. FIG. 10(A) shows an example of structure of a hexagonal unit cell 2 of negative permeability medium. The structure is such that the dielectric is left around a hexagonal metal patch 4 (i.e., hexagonal metal pattern) over the surface of a hexagonal dielectric substrate 5 and it has a grounding conductor 5 over the entire rear surface of the substrate 3. FIG. 10(B) shows a negative permeability medium 1 configured by gathering the hexagonal unit cells 2 of FIG. 10(A). This configuration can serve to reduce the anisotropy of each of the unit cells 2 and of the negative permeability medium 1.

A combination of media obtained by coupling side by side as shown in FIG. 7 the negative permeability medium 1 of FIG. 10(B) obtained in this way and the positive permeability medium, which is also hexagonal but comprises unit cells 6 of the same configuration as what is shown in FIG. 6, can provide a waveguide which propagates surface waves on the boundary between the two media.

Although the foregoing description of the embodiment referred to the configuration of the negative permeability medium and a combination of a negative permeability medium and a positive permeability medium, configuring similarly a combination of a negative permittivity medium and a positive permittivity medium could also provide a waveguide which propagates surface waves by way of the two media on the boundary between them. In this connection, an embodiment combining a negative permittivity medium and a positive permittivity medium will be described next.

Embodiment 3

Figure 11:
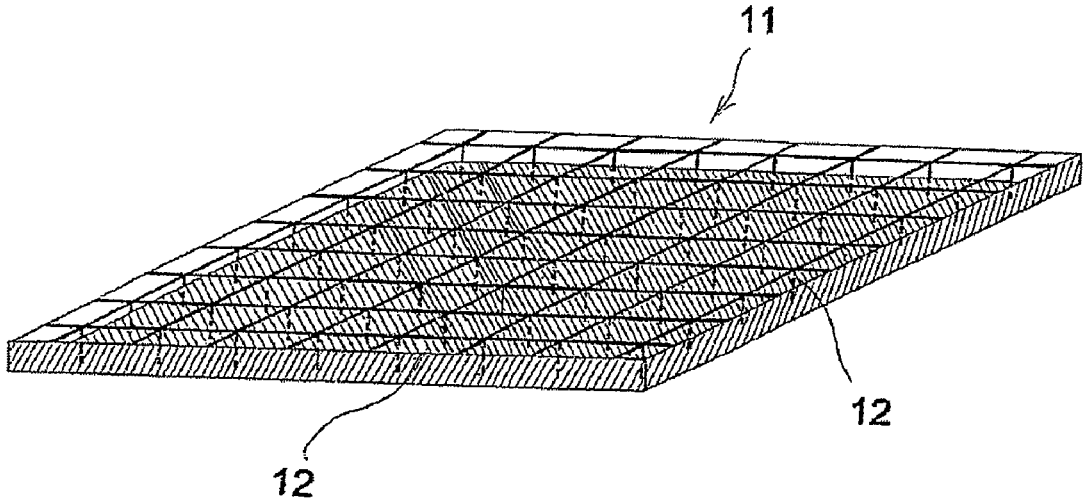
FIG. 11 schematically shows a negative permittivity medium.
Figure 12A:
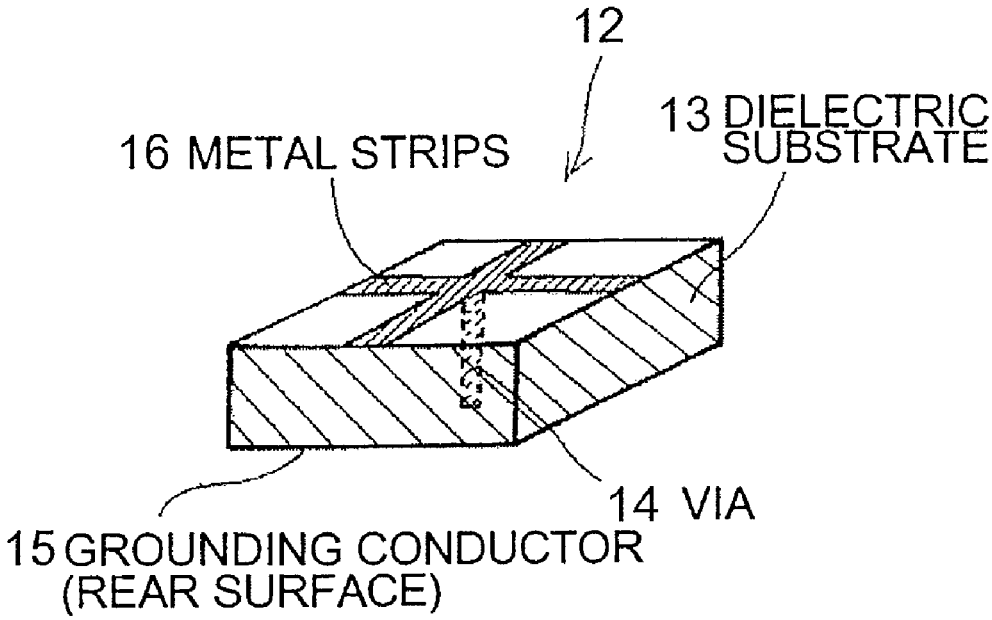
FIGS. 12(A) and 12(B) show a negative permittivity medium unit cells and an equivalent circuit thereto respectively.

FIG. 11 is a schematic diagram of a negative permittivity medium 11, which is a third embodiment of the invention, wherein the negative permittivity medium 11 is formed of a plurality of unit cells 12 gathered together. FIG. 12(A) shows a square unit cell 12 constituting part of the negative permittivity medium 11 of FIG. 11. The structure is such that metal strips 16 are formed over the front surface of a dielectric substrate 13, and the rear surface of the dielectric substrate 13 has a grounding conductor 15 all over. It comprises these metal strips 16 and a via (through hole) 14 which connects them to the grounding conductor 15 from the center or elsewhere. When putting together the negative permittivity medium, the metal strips 16 over the front surface of the substrate are connected to the metal strips between adjoining cells.

Figure 12B:
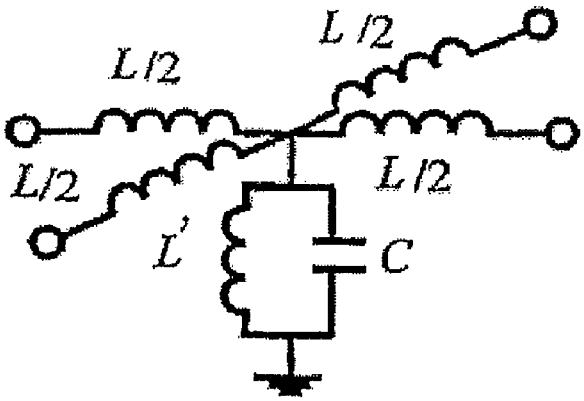

FIG. 12(B) shows an equivalent circuit to this unit cell 12. The metal strips 16 on the front surface have inductances L in series, and at the same time the equivalent circuit has an inductance L' to the grounding conductor 15 by way of the via 14 and a parasitic capacitance C in parallel therewith on the grounding conductor 15, but which is usually small enough to ignore. It is also known that a medium having such a serial inductance L and a parallel inductance L' in the range where the parallel capacitance C is small is proven to be a medium equivalently having a negative permittivity.

In this configuration, too, the symmetry of the shapes of the metal strips 16 and that of the unit cells 12 can be controlled, and so can be the anisotropy by varying the position of the via 14. Thus, it is possible to provide different permittivities with respect to different directions.

A combination of media obtained by coupling side by side the negative permittivity medium 11 of FIG. 11 obtained in this way and the positive permittivity medium, which comprises unit cells 6 of the same configuration as what is shown in FIG. 6, can provide a waveguide which propagates surface waves on the boundary between the two media.

Embodiment 4

Figure 13A:
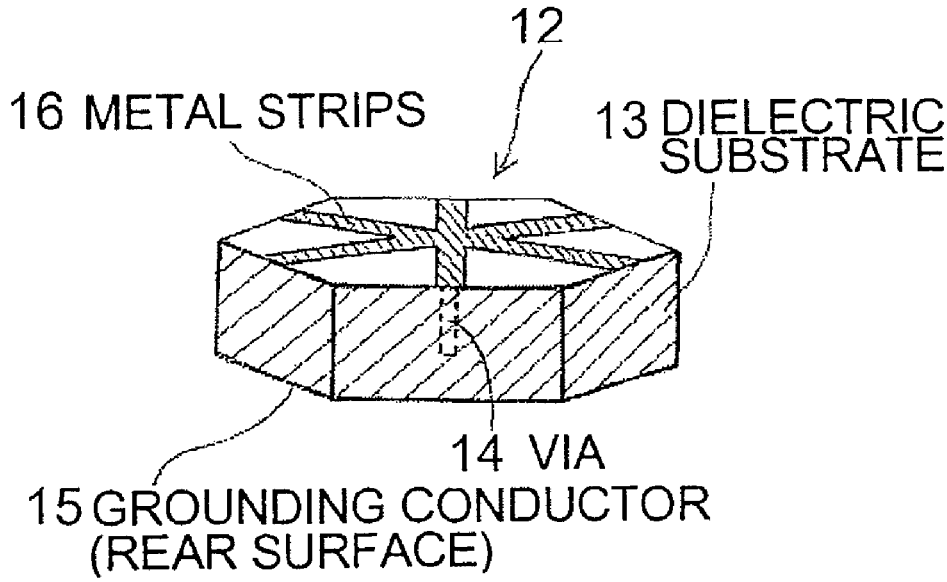
FIGS. 13(A) and 13(B) show a hexagonal negative permittivity medium unit cell and a negative permittivity medium configuration using the same, respectively.

Next, another embodiment concerning the negative permittivity medium will be described. FIG. 13 are schematic diagrams of a negative permittivity medium 11, which is a fourth embodiment of the invention. FIG. 13(A) shows an example of structure of a unit cell 12 of a hexagonally shaped negative permittivity medium.

This embodiment has a structure in which hexagonal metal strips 16 connecting the rear surface of the hexagonal dielectric substrate 13 and the centers of the sides of the hexagon are formed, and the rear surface of the substrate 13 has the grounding conductor 5 all over. The structure is such that metal strips 16 are formed over the front surface of a dielectric substrate 13, and the rear surface of the dielectric substrate 13 has a grounding conductor 15 all over. It comprises these metal strips 16 and the via (through hole) 14 which connects them to the grounding conductor 15 over the substrate from the center or elsewhere. When putting together the negative permittivity medium, the metal strips 16 over the front surface of the substrate are connected to the metal strips between adjoining cells.

Figure 13B:
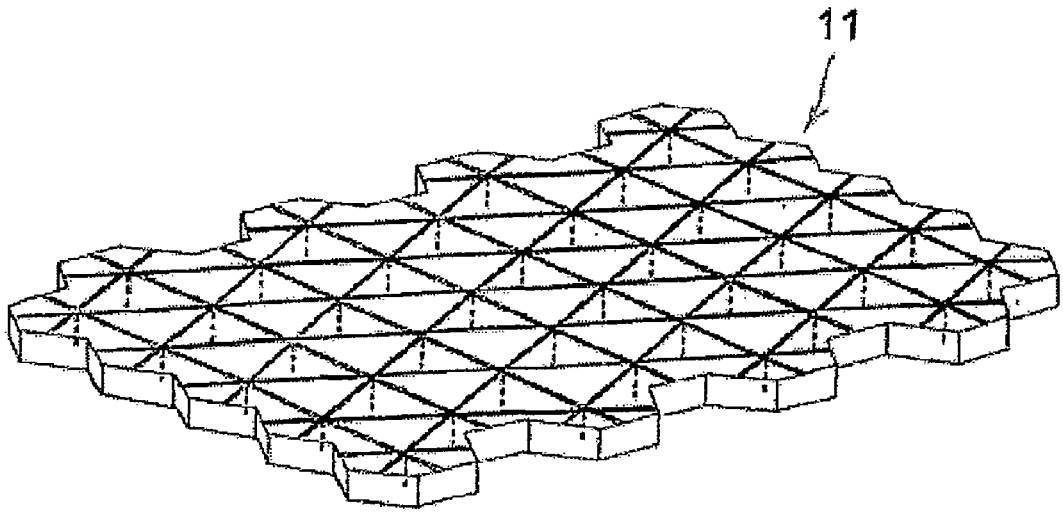

FIG. 13(B) shows a negative permittivity medium 11 configured by putting together the hexagonal unit cells 12 of FIG. 13(A). This configuration can serve to make the anisotropy of each of the unit cells 12 and of the negative permittivity medium 11 smaller than that of square ones.

In this configuration, too, the symmetry of the shapes of the metal strips 16 and that of the unit cells 12 can be controlled, and so can be the anisotropy by varying the position of the via 14. Thus, it is possible to provide different permittivities with respect to different directions.

A combination of media obtained by coupling side by side as shown in FIG. 7 the negative permittivity medium 11 of FIG. 13 obtained in this way and the positive permittivity medium 7, which is also hexagonal but comprises unit cells 6 of the same configuration as what is shown in FIG. 6, can provide a waveguide which propagates surface waves on the boundary between the two media.

INDUSTRIAL APPLICABILITY

As hitherto described, the present invention permits extensive use as circuit elements which require characteristics of negative permittivity media or positive permittivity media, which are metamaterials, and enables a waveguide using the same for propagating surface waves to be formed, which can be extensively utilized as constituent elements for devices such as resonators, filters, oscillators and so forth for microcommunication.

The invention claimed is:

1. A negative permeability metamaterial, for a positive/negative permeability medium, including:

a dielectric substrate having a front surface and an opposing, rear surface;

a grounding conductor formed over the entire rear surface of the dielectric substrate; and a plurality of conductor patterns periodically arrayed over the front surface of the dielectric substrate and formed in a square shape, wherein the conductor patterns are disposed under D.C. insulation from other conductor patterns and the grounding conductor, the metamaterial, manifesting negative permeability to propagating electromagnetic waves, being configured with a medium having a positive permeability to enable the propagating of surface waves.

2. The negative permeability metamaterial according to claim 1, wherein the vertical and lateral lengths of the conductor patterns are differentiated to provide anisotropy regarding permeability.

3. A negative permeability metamaterial, for a positive/negative permeability medium, including:

a dielectric substrate having a front surface and an opposing, rear surface;

a grounding conductor formed all over the rear surface of the dielectric substrate; and a plurality of conductor patterns periodically arrayed over the front surface of the dielectric substrate and formed in a hexagonal shape, wherein the conductor patterns are disposed under D.C. insulation from other conductor patterns and the grounding conductor, the metamaterial, manifesting negative permeability to propagating electromagnetic waves, being configured with a medium having a positive permeability to enable the propagating of surface waves.

4. A negative permittivity metamaterial, for a positive/negative permittivity medium, including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, the metamaterial, manifesting negative permittivity to propagating electromagnetic waves, being configured with a medium having a positive permittivity to enable the propagating of surface waves.

5. A negative permittivity metamaterial, for a positive/negative permittivity medium, including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically;

a third conductor strip formed in a third direction over the front surface of the dielectric substrate and to cross the first conductor strip and the second conductor strip in the crossing position between the first conductor strip and the second conductor strip, and arrayed periodically; and a conductor via arranged to match each crossing position of the first through third conductor strips, and connecting at least one of the first through third conductor strips to the grounding conductor, the metamaterial, manifesting negative permittivity to propagating electromagnetic waves, being configured with a medium having a positive permittivity to enable the propagating of surface waves.

6. A negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, wherein the metamaterial manifesting negative permittivity to propagating of surface electromagnetic waves, anisotropy regarding permeability is provided by decomposing the directional symmetry of the conductor strips.

7. A negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically;

a third conductor strip formed in a third direction over the front surface of the dielectric substrate and to cross the first conductor strip and the second conductor strip in the crossing position between the first conductor strip and the second conductor strip, and arrayed periodically; and a conductor via arranged to match each crossing position of the first through third conductor strips, and connecting at least one of the first through third conductor strips to the grounding conductor, the metamaterial manifesting negative permittivity to propagating of surface electromagnetic waves, wherein anisotropy regarding permeability is provided by decomposing the directional symmetry of the conductor strips.

8. The negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, the metamaterial manifesting negative permittivity to propagating of surface electromagnetic waves, wherein anisotropy regarding permeability is provided by altering the position of the conductor via.

9. A negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically;

a third conductor strip formed in a third direction over the front surface of the dielectric substrate and to cross the first conductor strip and the second conductor strip in the crossing position between the first conductor strip and the second conductor strip, and arrayed periodically; and a conductor via arranged to match each crossing position of the first through third conductor strips, and connecting at least one of the first through third conductor strips to the grounding conductor, the metamaterial manifesting negative permittivity to propagating of surface electromagnetic waves, wherein anisotropy regarding permeability is provided by altering the position of the conductor via.

10. A surface wave waveguide comprising:

a negative permeability metamaterial and a medium having a positive permeability which are positioned adjacent to each other, the negative permeability metamaterial including:

a dielectric substrate having a front surface and an opposing, rear surface;

a grounding conductor formed over the entire rear surface of the dielectric substrate; and a plurality of conductor patterns periodically arrayed over the front surface of the dielectric substrate and formed in a square shape, wherein the conductor patterns are disposed under D.C. insulation from other conductor patterns and the grounding conductor, the metamaterial manifesting negative permeability to propagating of surface electromagnetic waves, and surface waves are enabled to propagate on the boundary between the negative permeability metamaterial and the positive permeability medium.

11. A surface wave waveguide comprising:

a negative permeability metamaterial and a medium having a positive permeability which are positioned adjacent to each other, the negative permeability metamaterial including:

a dielectric substrate having a front surface and an opposing, rear surface;

a grounding conductor formed over the entire rear surface of the dielectric substrate; and a plurality of conductor patterns periodically arrayed over the front surface of the dielectric substrate and formed in a square shape, wherein the conductor patterns are disposed under D.C. insulation from other conductor patterns and the grounding conductor, the metamaterial manifesting negative permeability to propagating of surface electromagnetic waves, the vertical and lateral lengths of the conductor patterns are differentiated to provide anisotropy regarding permeability, and surface waves are enabled to propagate on the boundary between the negative permeability metamaterial and the positive permeability medium.

12. A surface wave waveguide comprising:

a negative permeability metamaterial and a medium having a positive permeability which are positioned adjacent to each other, the negative permeability metamaterial including:

a dielectric substrate having a front surface and an opposing, rear surface;

a grounding conductor formed all over the rear surface of the dielectric substrate; and a plurality of conductor patterns periodically arrayed over the front surface of the dielectric substrate and formed in a hexagonal shape, wherein the conductor patterns are disposed under D.C. insulation from other conductor patterns and the grounding conductor, the metamaterial manifesting negative permeability to propagating of surface electromagnetic waves, and surface waves are enabled to propagate on the boundary between the negative permeability metamaterial and the positive permeability medium.

13. A surface wave waveguide comprising:

a negative permittivity metamaterial and a medium having a positive permittivity which are positioned adjacent to each other, the negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically; and a conductor via arranged to match each crossing position of the first conductor strip and the second conductor strip, and connecting at least one of the first conductor strip and the second conductor strip to the grounding conductor, the metamaterial manifesting negative permittivity to propagating of surface electromagnetic waves, wherein surface waves are enabled to propagate on the boundary between the negative permittivity metamaterial and the positive permittivity medium.

14. A surface wave waveguide comprising:

a negative permittivity metamaterial and a medium having a positive permittivity which are positioned adjacent to each other, the negative permittivity metamaterial including:

a dielectric substrate having a front surface and an opposing, rear surface;

a grounding conductor formed over the entire rear surface of the dielectric substrate;

a first conductor strip formed in a first direction over the front surface of the dielectric substrate and arrayed periodically;

a second conductor strip formed in a second direction crossing the first direction over the front surface of the dielectric substrate and arrayed periodically;

a third conductor strip formed in a third direction over the front surface of the dielectric substrate and to cross the first conductor strip and the second conductor strip in the crossing position between the first conductor strip and the second conductor strip, and arrayed periodically; and a conductor via arranged to match each crossing position of the first through third conductor strips, and connecting at least one of the first through third conductor strips to the grounding conductor, the metamaterial manifesting negative permittivity to propagating of surface electromagnetic waves, wherein surface waves are enabled to propagate on the boundary between the negative permittivity metamaterial and the positive permittivity medium.

* * * * *